US005540137A

United States Patent [19]

Lark et al.

[11] Patent Number: 5,540,137

[45] Date of Patent: Jul. 30, 1996

[54] ELECTRICAL CONTACTING IN ELECTROMAGNETIC WAVE PISTON POSITION SENSING IN A HYDRAULIC CYLINDER

[75] Inventors: Wayne W. Lark, Joliet, Ill.; Denny Morgan, San Diego, Calif.; James R. Turba, Joliet, Ill.

[73] Assignee: Caterpillar Inc., Peoria, Ill.

[21] Appl. No.: 321,294

[22] Filed: Oct. 11, 1994

[51] Int. Cl.[6] ..... F01B 25/26; F01B 31/12

[52] U.S. Cl. ..... 92/5 R; 91/1; 91/DIG. 4

[58] Field of Search ..... 92/5 R; 91/1, DIG. 4, 91/361; 277/2, 58, 163, 164

[56] References Cited

U.S. PATENT DOCUMENTS

| | | | |
|---|---|---|---|
| 624,365 | 5/1899 | Mullen | 92/193 |
| 1,473,446 | 11/1923 | Scott | 277/163 |
| 1,703,905 | 3/1929 | Solenberger . | |
| 2,962,331 | 11/1960 | Folkerts | 309/29 |
| 3,068,018 | 12/1962 | Tydeman | 277/165 |
| 4,522,412 | 6/1985 | Kubo | 277/138 |
| 4,588,953 | 5/1986 | Krage | 324/58.5 |
| 4,737,705 | 4/1988 | Bitar et al. | 324/58.5 |
| 4,793,241 | 12/1988 | Mano et al. | 91/DIG. 4 X |
| 4,896,584 | 1/1990 | Stoll et al. | 91/DIG. 4 X |
| 4,982,652 | 1/1991 | Blatt | 92/5 R |
| 5,108,078 | 4/1992 | Balsells | 277/163 X |
| 5,139,276 | 8/1992 | Balsells | 277/163 |
| 5,182,979 | 2/1993 | Morgan | 92/5 |
| 5,222,429 | 6/1993 | Garman et al. | 92/193 |

FOREIGN PATENT DOCUMENTS

| | | |
|---|---|---|
| 974917 | 11/1948 | France . |
| 596000 | 6/1945 | United Kingdom . |

OTHER PUBLICATIONS

Bal Seal—Technical Brochure—Santa Ana, CA—Jan. 94—2 pages.

*Primary Examiner*—Hoang Nguyen
*Attorney, Agent, or Firm*—Alvin J. Riddles

[57] ABSTRACT

A contacting and sealing structure, for electrical continuity, noise reduction and leakage reduction between parts that move in relation to each other at the ends of the cavity within a hydraulic cylinder employing electromagnetic wave position sensing, is provided by employing two springs having garter and canted coil spring functions that are retained in side by side grooves in one of the parts so that the spring coils extend directly across the intersection of the parts.

11 Claims, 1 Drawing Sheet

ELECTRICAL CONTACTING IN ELECTROMAGNETIC WAVE PISTON POSITION SENSING IN A HYDRAULIC CYLINDER

TECHNICAL FIELD

The invention relates to the sensing of the position of a piston and rod combination in a hydraulic cylinder using electromagnetic waves in the hydraulic fluid in the cylinder and in particular to electrical contacting in the cylinder and prevention of leakage of the electromagnetic waves at locations where there are moveable parts.

BACKGROUND AND RELATION TO THE PRIOR ART

Hydraulic cylinder and piston combinations are being increasingly used in fields that involve the moving and positioning of material and objects. As the various applications of hydraulic cylinder and piston combinations have progressed, more stringent operational criteria are being encountered, and a need has developed to precisely, reliably and continuously sense the position of the piston and it's related displacement parameters, velocity and acceleration.

A promising approach developing in the art employs the use of electromagnetic waves in the hydraulic fluid in the cylinder in determining the position of the piston. In one aspect of this approach, the wave performance in the fluid in the cylinder is comparable to wave performance in a transmission line with shorted ends in that the resonance frequency of an electromagnetic standing wave correlates directly with the transmission line length when the length of the interior of the cylinder between the end and the piston is considered the cavity and the end and the piston are considered to be the shorted ends of the transmission line.

One application of the use of electromagnetic waves for piston position sensing is shown in U.S. Pat. 4,588,953 wherein the frequency, of electromagnetic waves introduced into the cylinder between the closed end of the cylinder and the piston, is swept between two limits with the frequency of the detected resonant peak being indicative of the piston position.

In U.S. Pat. No. 4,737,705 improvement is achieved by providing a coaxial resonant cavity, that is a cavity with a central core member, and in which the electromagnetic waves are launched and propagated in the mode referred to as the transverse electromagnetic wave (TEM) mode. The cylinder on the rod side of the piston is one type of coaxial cavity.

In U.S. Pat. No. 5,182,979, further improvement is made by detecting the resonance frequency values in signal processing sections for transmitting and receiving, the receiving one of which compensates for differences in insertion losses as the linear extension of the piston and rod in the cylinder takes place.

As progress in the art is developing, greater precision is being sought in resonant frequency detection. It is becoming of importance to improve the short circuit aspect of the piston and the end of the cylinder as ends of a transmission line and to prevent leakage of the electromagnetic waves from the cylinder.

In U.S. Pat. No. 5,222,429 the problem of electromagnetic wave leakage from the cylinder is recognized and a sealing structure, made up of a split ring over an expansion member positioned in a groove of the piston, is described.

SUMMARY OF THE INVENTION

An improved electromagnetic wave cavity termination contacting system is provided for use in a hydraulic cylinder electromagnetic wave piston position sensing system. Two spring members that have garter and canted coil spring functions are positioned side by side each in a groove and are in direct contact across the intersection between parts that move with relation to each other and which are electrically part of the shorted end of the cavity.

DESCRIPTION OF THE INVENTION

In electromagnetic sensing of the position of the piston and rod combination in a hydraulic cylinder, the cylinder serves as an electromagnetic wave cavity and in the presence of a band of frequencies, which may for example be from 50 mega hertz (MHz) to 1.6 giga hertz (GHz), a standing electromagnetic wave is set up in the hydraulic fluid with the position of the piston being determined by frequency resonances that are directly related to the length of the cavity which is the distance from the end of the cylinder to the piston.

In an electrical sense, the cavity may be considered to be a transmission line with shorted ends. However, in the case of a piston and rod in a hydraulic cylinder, the "end" that is to be a short circuit, includes an intersection between mechanical parts that may move with respect to each other. Any variation in electrical parameters at that intersection results in noise that can affect the ability to precisely determine resonance frequencies and any leakage deteriorates the wave conditions in the cavity. In accordance with the invention an improvement in electromagnetic wave cavity termination for a hydraulic cylinder electromagnetic wave piston position sensing system, is achieved by providing as a contact between the moveable parts that are electrically part of the shorted end of the cavity, the simple and reliable structure of two,side by side spring members, that have garter and canted coil spring functions and are each retained in a groove.

Figure 1:
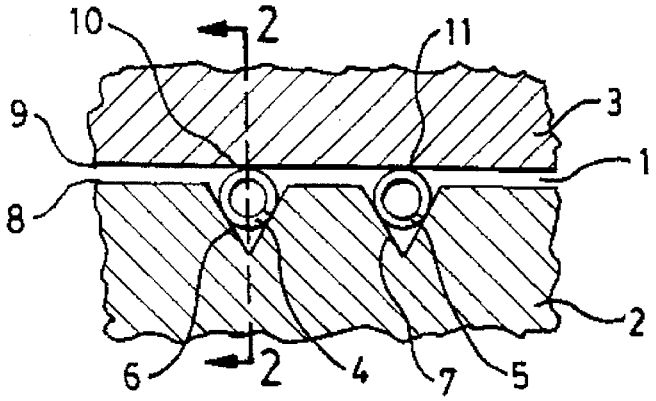
FIG. 1 is a cross sectional illustration of two garter canted coil groove retained spring members in direct contact across an intersection of parts that move with relation to each other.

Referring to FIG. 1, a cross sectional illustration is provided of the electrical contacting member of the invention in position across the intersection of parts that move with relation to each other and which are part of the termination of the cavity.

Figure 2:
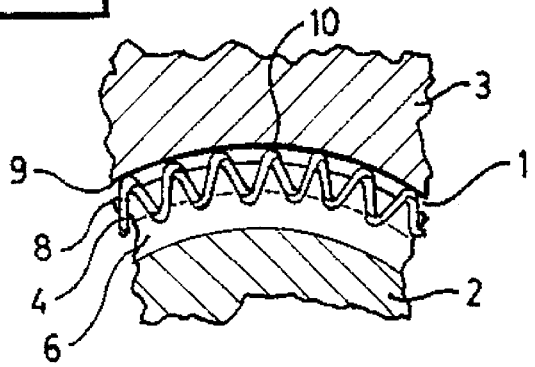
FIG. 2 is a schematic cross sectional side view along the line 2—2 of FIG. 1.

In FIG. 1, at an intersection 1 between a first part 2 and a second part 3, the parts 2 and 3 are moveable with respect to each other, as would be the case if one part were to be the piston or the rod and the other part were to be the cylinder or the head. First and second, groove retained, garter, canted coil, springs 4 and 5, are positioned in grooves 6 and 7 respectively. The grooves may be any shape that supports the spring, insures contact, and is of a depth such that the spring coil extends above the surface 8 of the part 2 and into contact with the surface 9 of the part 3. A groove such as the V shape illustrated is satisfactory. The canting function of the springs 4 and 5 provides steady contact pressure concentrated at the tangential portions of the respective coil curves 10 and 11. The springs have a garter type function which in essence is a circumferential structural shape with a length such that it encircles the periphery of the piston or rod, retaining itself in the groove through expansion or compression, while the length is such that the parts 2 and 3 when in position cause the spring coils to bend over or cant. The features of the coils may be further seen in FIG. 2 which is a schematic cross sectional side view, along the lines 2—2 of FIG. 1 of a portion of the intersection between parts 2 and 3 along coil 4 using the same reference numerals as in FIG. 1. In FIG. 2 the depth of the groove 6, the spacing at the intersection 1, and the height of the coils are interrelated such that the coils are at a canted angle as depicted by the slope of the individual coil segments in FIG. 2. The coils are a commercial product, one manufacturer is the Balseal Corp. of Santa Ana, Calif. A coil diameter of 3 mm and with a wire diameter of 0.010 to 0.014 in. stainless steel or beryllium copper is satisfactory.

In service, in a hydraulic cylinder, continuity can be disrupted and the electromagnetic energy can leak out at the intersection of the piston and the cylinder wall and in cylinders where the rod side of the piston is used as a coaxial type of cavity continuity disruption and leakage can also occur at the intersection of the rod and the head the rod goes through. The two intersections are each of the type illustrated and discussed in connection with FIGS. 1 and 2 and are illustrated together in cross section with the contacting of the invention in FIG. 3, using the same reference numerals.

Figure 3:
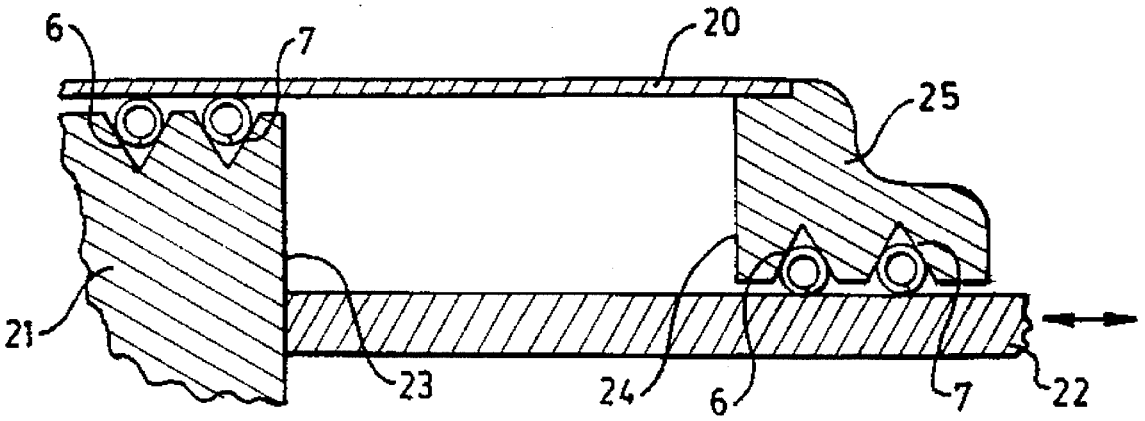
FIG. 3 is a schematic cross sectional illustration of the invention in both the head surrounding the rod and the piston in a hydraulic cylinder.

Referring to FIG. 3, in a cylinder 20, a piston 21 with attached rod 22, moves in either direction, as depicted by the double headed arrow, under the influence of fluid pressure against the piston 21. The cavities, only one of which is shown, formed by the piston, the ends of the cylinder and the cylinder wall, are useable for electromagnetic wave piston position determination. In the determination, resonance frequencies are directly related to the length of a transmission line cavity with shorted ends where, in the hydraulic cylinder, the piston and the head are the ends to be shorted.

It will be apparent that the performance of the position determination system will be directly related to the quality of the electrical continuity in the shorting over the ends. One end being the face 23 of the piston 21 and the other being the face 24 of the head 25. The intersections between the cylinder 20 wall and the piston 21 around the circumference of the piston 21 is one region of potential electrical discontinuity and leakage at the intersection between the head 25 and the rod 22 around the circumference of the rod 22 is a second region of potential electrical discontinuity and leakage.

The intersections that form the regions of potential electrical discontinuity and leakage are in different parts of the overall structure and present different problems in assembly that influence procedures and selection of parts. Heretofore in the art a canted coil spring has been used as an expansion member under a solid contacting member. The simplicity and reliability of the two canted coil contact of FIGS. 1 and 2 is of benefit in assembly where, before the piston and rod is inserted into the cylinder and head, the coils are merely placed in the grooves and hold themselves in place during other operations in assembly. In accordance with the invention, as illustrated in FIGS. 1 and 2 the canted coil turn itself serves as the contact with the spring force from being canted being concentrated at the tangential point of contact with the part on the other side of the intersection. The two garter canted coil springs provide contact points at each turn of the coil all around the periphery of the part, the piston and the rod. The resulting quantity and distribution of contact points radically reduces noise in the system.

It should be further noted that the purpose of the invention is electrical continuity rather than oil containment. In hydraulic systems there are oil leakage control mechanisms, not shown.

What has been described provides improved continuity in shorting the ends of the cavity within a hydraulic cylinder employing electromagnetic wave piston position sensing thereby reducing leakage and reducing noise.

Other aspects of the invention can be obtained from the study of the drawings, this disclosure and the appended claims.

We claim:

1. In a hydraulic cylinder electromagnetic wave piston position sensing system cavity, the improvement comprising:

first and second electrical contact members between first and second metal parts in movable relationship at and along an intersection between said parts, said first and second electrical contact members being canted coil springs with garter spring functions mounted in side by side relationship in grooves in said first metal part and directly contacting said second metal part.

2. The improvement of claim 1 wherein said first metal part is the piston of the system.

3. The improvement of claim 1 wherein said first metal part is a rod bearing head of the system.

4. In a hydraulic cylinder electromagnetic wave piston position sensing system, at an intersection in a termination end in the electrical transmission line in said cylinder, said termination end being at least one of the face of said piston and the face of the end of said cylinder, and including first and second metal parts that can move with respect to each other, the improvement comprising:

first and second canted coil spring members, said spring members further having garter spring functions, said spring members being retained in grooves in side by side relationship in said first metal part, and, said spring members being in direct contact with said second metal part.

5. The improvement of claim 4 wherein said first metal part is the piston of the system.

6. The improvement of claim 4 wherein said first metal part is a rod bearing head of the system.

7. A hydraulic cylinder electromagnetic wave piston and rod position sensing system wherein, in an electromagnetic wave cavity in the cylinder between the piston as one end and the end of the cylinder as the other end, a cavity termination structure for an end including an intersection between first and second members that are in contact and moveable with respect to each other, comprising:

an electrical contact across said intersection between said first and second members, said electrical contact including first and second canted coil spring members, said spring members further having garter spring functions, said spring members being retained in grooves in side by side relationship in the surface of said first member at said intersection, said spring members being in direct contact with the surface of said second member at said intersection.

8. The cavity termination structure of claim 7 wherein each of said spring members is retained in one of said grooves having a supporting shape.

9. The cavity termination structure of claim 8 wherein said intersection is between the cylinder and the piston.

10. The cavity termination structure of claim 8 wherein said intersection is between the rod bearing head and the rod.

11. In a hydraulic cylinder electromagnetic wave piston position sensing system, the improvement comprising:

an electrical contact across an intersection between first and second metal parts in contact in movable relationship, said intersection between said first and said second metal parts being at least one of the piston and cylinder combination and a rod and head combination of said sensing system, said contact including a plurality of at least first and second canted coil spring members, said spring members further having garter coil spring functions, said spring members being retained in grooves in side by side relationship in a first of said first and second metal parts, and, said spring members being in direct contact with a second of said first and second metal parts.

* * * * *